US007950875B2

(12) United States Patent
Benham

(10) Patent No.: US 7,950,875 B2
(45) Date of Patent: May 31, 2011

(54) WATER FEATURE DEVICE

(76) Inventor: Roger A. Benham, San Diego, CA (US)

( * ) Notice: Subject to any disclaimer, the term of this patent is extended or adjusted under 35 U.S.C. 154(b) by 83 days.

(21) Appl. No.: 12/309,405

(22) PCT Filed: May 21, 2008

(86) PCT No.: PCT/US2008/006493

§ 371 (c)(1),
(2), (4) Date: Jan. 16, 2009

(87) PCT Pub. No.: WO2008/147508

PCT Pub. Date: Dec. 4, 2008

(65) Prior Publication Data

US 2009/0285633 A1 Nov. 19, 2009

Related U.S. Application Data

(60) Provisional application No. 60/924,651, filed on May 24, 2007.

(51) Int. Cl.
*E02B 3/00* (2006.01)

(52) U.S. Cl. ..... 405/79; 472/128; 4/491

(58) Field of Classification Search ..... 405/79; 472/128; 4/491

See application file for complete search history.

(56) References Cited

U.S. PATENT DOCUMENTS

| | | | | |
|---|---|---|---|---|
| 586,718 | A | 7/1897 | Wharton | |
| 765,093 | A | 7/1904 | Miller | |
| 931,863 | A | 8/1909 | Haight | |
| 1,076,779 | A | 10/1913 | Miller | |
| 1,664,140 | A * | 3/1928 | Tucker | 4/491 |
| 2,064,035 | A | 12/1936 | Rynearson | |
| 3,005,207 | A | 10/1961 | Matrai | |
| 3,477,233 | A | 11/1969 | Andersen | |
| 3,562,823 | A | 2/1971 | Köster | |
| 3,635,448 | A * | 1/1972 | Okada | 4/491 |
| 3,913,332 | A * | 10/1975 | Forsman | 405/79 |
| 4,290,153 | A * | 9/1981 | Kockerols et al. | 405/79 |
| 4,375,337 | A * | 3/1983 | Yerger | 405/79 |
| 5,271,692 | A * | 12/1993 | Lochtefeld | 405/79 |
| 5,387,159 | A * | 2/1995 | Hilgert et al. | 405/79 |
| 5,564,859 | A | 10/1996 | Lochtefeld | |
| 5,720,056 | A | 2/1998 | Aymes | |
| 5,774,909 | A | 7/1998 | Stable | |
| 5,899,633 | A * | 5/1999 | Lochtefeld | 405/79 |
| 6,132,317 | A | 10/2000 | Lochtefeld | |
| 6,336,771 | B1 | 1/2002 | Hill | |
| 6,920,651 | B2 * | 7/2005 | Roberts | 405/79 |
| 2005/0047869 | A1 * | 3/2005 | Lochtefeld | 405/79 |
| 2006/0042022 | A1 | 3/2006 | Kim et al. | |
| 2006/0260697 | A1 | 11/2006 | Lochtefeld | |

FOREIGN PATENT DOCUMENTS

| | | |
|---|---|---|
| CA | 2470714 | 3/2003 |
| WO | WO 2007/047000 | 4/2007 |

* cited by examiner

*Primary Examiner* — Frederick L Lagman

(74) *Attorney, Agent, or Firm* — Welsh Flaxman & Gitler LLC

(57) ABSTRACT

A device for generating and maintaining a standing wave face capable of being ridden by an individual. The device includes a container having a base wall and a sidewall and containing a fluid, at least one inlet into the container, and means for imparting a combination of rotational vertical and horizontal velocity to a fluid with-in the container.

24 Claims, 12 Drawing Sheets

WATER FEATURE DEVICE

This application claims benefit of PCT/US08/06493 filed May 21, 2008 which claims priority from U.S. Provisional Application 60/924,651, filed May 24, 2007.

FIELD OF THE INVENTION

The present invention relates to a device of creating a standing wall of water, or wave, for recreation and hydrodynamic testing and in particular to a recreational wave generating device that has inherent and designed energy efficiencies.

BACKGROUND ART

Many wave and water recreation devices and system exist. One example of this device is disclosed in U.S. Pat. No. 6,336,771 to Hill.

The device taught in Hill is a wave-forming device including a rotatable container of water and a power source for rotating the container. A water-shaping aerofoil structure is disposed in the container for shaping the body of water. The wave-forming device is also provided adjacent to and trailing the aerofoil structure, and includes an inclined surface. The aerofoil structure and wave-forming device together form a surfable wave upon rotation of the body of water in the container. Transparent structures may be used to enable spectators to view, from the side or underside, a surfer riding a wave form on the wave-forming device. It is noted that according to the structure taught in Hill, the entire container of water rotates. This expands large amounts of energy and mechanical appurtenances in order to accelerate and maintain the entire container sufficiently in such that a wave can be formed and operated. The structure taught in Hill provides no means or provision for a continuous circuit of fluid flow including a vertical component of fluid velocity.

Other examples of wave forming devices or water features adapted for riders to ride, include those disclosed in United States Published Application Number 2006260697 to Lochtefeld and International Patent Application Number WO2007/047000 to McFarland, although neither of these devices are particularly close to that of the present application.

The above-mentioned wave generation designs all have their shortcomings. The present invention is designed to create an improved wave generating device to help overcome the disadvantages of the existing art.

Some benefits include:

- Energy efficient. The angular momentum and differential head pressure energies of the water are conserved by use of a contained or uncontained concentric annulus for a pumping circuit.
- Simple design. No required grates, gateways, channels, gears, chains, belts, etc. Reliable. For example, can use only one moving part (disc or impeller) for a 30 meter diameter bowl.
- Low power usage. Can operate on one hydraulic motor powered with biodiesel.
- Simple land based design. Make a hole, install three basic components.
- Simple portable or barge design. Can be factory made and shipped anywhere.
- Safety. Deeper water than other simulated standing wave machines. Minimized need for "padding". No highly concentrated high-force water streams that can cause injury or entrapment. Although the word "safety" is used, as with all activities and water sports, accidents that can cause serious injury or death or drowning can occur, and all precautions must be taken seriously.
- Multiple riders can ride at the same time (if the unit is big enough)
- Capable of forming one or multiple tubes and lip and other trick features with simple removable and changeable optional attachments.
- Scaleable. The same unit can make small waves or huge waves (10 meter standing wave is possible).
- Multiple devices can be connected together in any number to create a ride or race course that can as long as desired.

All of these features are important to create an improved means of divergence and improving water sports skills and equipment testing and design, in particular for the sport of surfing. This all adds to more challenges and conveniences for the consumer.

It will be clearly understood that, if a prior art publication is referred to herein, this reference does not constitute an admission that the publication forms part of the common general knowledge of the art in any other country or jurisdiction.

SUMMARY OF THE INVENTION

The present invention is directed to a water wave generator, creating a rideable wave, which may at least partially overcome at least one of the abovementioned disadvantages or provide the consumer with a useful or commercial choice.

The present invention includes a device for conserving the kinetic energy of angular momentum and the energy from differential elevation of a body of moving fluid, a device for changing the form of the wave surface during operation, a device of material applications for structural and weight and portability advantages, a device for placement and support of the wave generating device in existing water ways, land bases or pool bodies, and a device for augmenting the wave generating device with features supporting theme part amenities.

With the foregoing in view, the present invention in one form, resides broadly in a water feature for generating and maintaining a standing wave face, the water feature including a circular container having a base wall and a cylindrical sidewall and containing a fluid, at least one inlet into the circular container, and a device for imparting a combination of rotational and vertical velocity to a fluid within the container.

The present invention may also be thought of as a standing wave generator.

Normally, the water feature of the present invention will include an inner and an outer container. The inner container will typically be referred to as the primary container and the outer container as a secondary container. Normally, the primary and secondary containers are spaced apart concentrically. It is preferred that sufficient distance is provided between the primary and secondary container walls such that a flattened portion of fluid may be formed at the top between the primary and secondary container. It is noted here that the outer container is an option that increases the energy efficiency of the system and is not essential.

According to this preferred form, the fluid in the secondary container will typically rotate and descend as the fluid in the primary container rotates and ascends. However, the fluid in the secondary container will move more slowly than that in the inner container. Importantly, the fluid in the secondary container maintains the same momentum as the fluid in the primary container which will assist in the maintaining of energy efficiency, so that the method for imparting rotational and upward velocity to the fluid need not increase the movement of the fluid from stagnant to relatively higher speeds required within the primary container to form the standing wave face.

The fluid in the secondary container will normally rotate more slowly than the fluid in the primary container due to the laws of conservation of momentum, similar to a when a twirling ice skater changes angular velocity by moving their arms outward, or conversely increases rotation speed by moving arms inward.

The primary container will typically include a base wall with upstanding edge portions or skirts. The area between the base wall and the upstanding edge portions will typically be arcuate or angled. The arcuate or angled portions will preferably act as a deflection device to deflect the fluid which is forced outwardly due to the rotational and centrifugal forces acting on the fluid, upwardly.

The container will normally be manufactured of a material which is relatively lightweight but preferably strong such as an engineering plastic or fabric.

The sidewall of the primary container is preferably cylindrical. The sidewall may be provided with a tubular support ring about an upper edge of the side wall preferably at sufficient depth below the water to minimize or eliminate impact forces. The tubular support ring may be padded or similar in order to minimize injury of users striking the support ring.

All surfaces of the water feature of the present invention, particularly the surfaces which will be in contact with the fluid, may be lined with a material having a low coefficient of friction. The lining may be rigid sheet material, a spray on lining, or a separate lining sheet, or a combination thereof.

The base wall of the primary container will typically include a substantially central opening therethrough. The opening may provide an entry port or inlet for the fluid and may also provide the entry for part of the device to impart rotational and directional velocity to the fluid.

The device for imparting rotational velocity as well as vertical and horizontal components to the fluid can take many forms. These forms could include a fixed base plate with a central opening and rotating disk or impeller, a free-spinning base plate with a central opening and rotating impeller or a rotating base plate with a central opening. Various configurations of impellers are known and available and any of these suitable for the purpose may be used.

Where a traditional impeller is provided, the impeller would be housed in a shielded configuration to avoid any possible contact between the rotating impeller and a participant. The shielding surrounding the moving impeller will normally include outlet ports to direct angular and directional velocity to the fluid flow.

Where a rotating disk is provided, the rotating disk may impart rotational force to the fluid in the primary container by creating boundary layer drag between the fluid and the rotating disk. Normally the rotating disk will be provided substantially horizontally. The rotating disk may therefore be provided with roughened surface(s). In particular, the surface of the rotating disk may be provided with a plurality of flutes, channels or grooves, into or through the disk.

The edges of the rotating disk or impeller will normally be spaced from the sidewall and the disc itself will typically be spaced above the base wall of the primary container.

The rotating disk or impeller (collectively referred to in the alternative as a "rotor") will typically be mounted on a drive shaft. The drive shaft is typically provided through an opening in the base wall of the primary container. This opening is also typically the inlet for returning fluid into the primary container.

The fluid will typically be spun to a relatively high velocity which due to the rotational and centrifugal forces will be directed outwardly against the deflection device and upwardly to form the standard in wave face. As the fluid reaches the top of the sidewall of the primary container, the fluid will then typically flow over the sidewall in into an annular space between the primary and secondary containers. The fluid may then proceed on a flow path with a similar shape to a convection current but not driven by heat. The fluid will also continue to rotate as it proceeds on the convection current shaped flow path.

There may be a further inlet provided within the drive shaft area of the rotor to allow water to move upwardly through a rotor assembly. There may be more than one inlet into the drive shaft assembly. The fluid exiting the drive shaft assembly may be used to alter the fluid flow pattern and surfaces of the wave form.

There may also be a secondary impeller associated with the drive shaft assembly to assist with altering the fluid flow pattern and surfaces of the wave form.

There may be one or more secondary rotational devices provided in the annular space between the primary and secondary containers to assist with the maintenance of rotational momentum of the fluid in this area.

There will typically be support provided in order to support the primary container within the secondary container. The support will typically include a truss system. Where provided, the members of the truss system will typically be foil shaped in order to reduce drag on the fluid during rotation to maintain the rotational momentum of the fluid as high as possible.

The water feature of the present invention may be located in a body of water such as a lake or large pool or similar. Steps or similar may be provided for entry into the primary container. The water feature of the present invention will preferably be capable of floating or self buoyancy when provided in the body of water. There may be an overhead assembly or gantry provided extending at least partially above the primary and/or secondary container for maintenance, rescue, advertisements, announcements or instruction purposes.

Various attachments may be provided to the primary container in order to form waves of different shapes. For example a tube shaped wave may be performed by providing an arcuate lip at the top of the sidewall of the primary container which curves back towards the centre of the primary container. Normally, an attachment of this type need only be provided about part of the container, with the remainder of the container configured to allow entry or exit from the container.

BRIEF DESCRIPTION OF THE DRAWINGS

Various embodiments of the invention will be described with reference to the following drawings, in which.

DETAILED DESCRIPTION OF THE PREFERRED EMBODIMENT

With reference to FIG. 1 through 12 the present invention will be explained.

Figure 1:
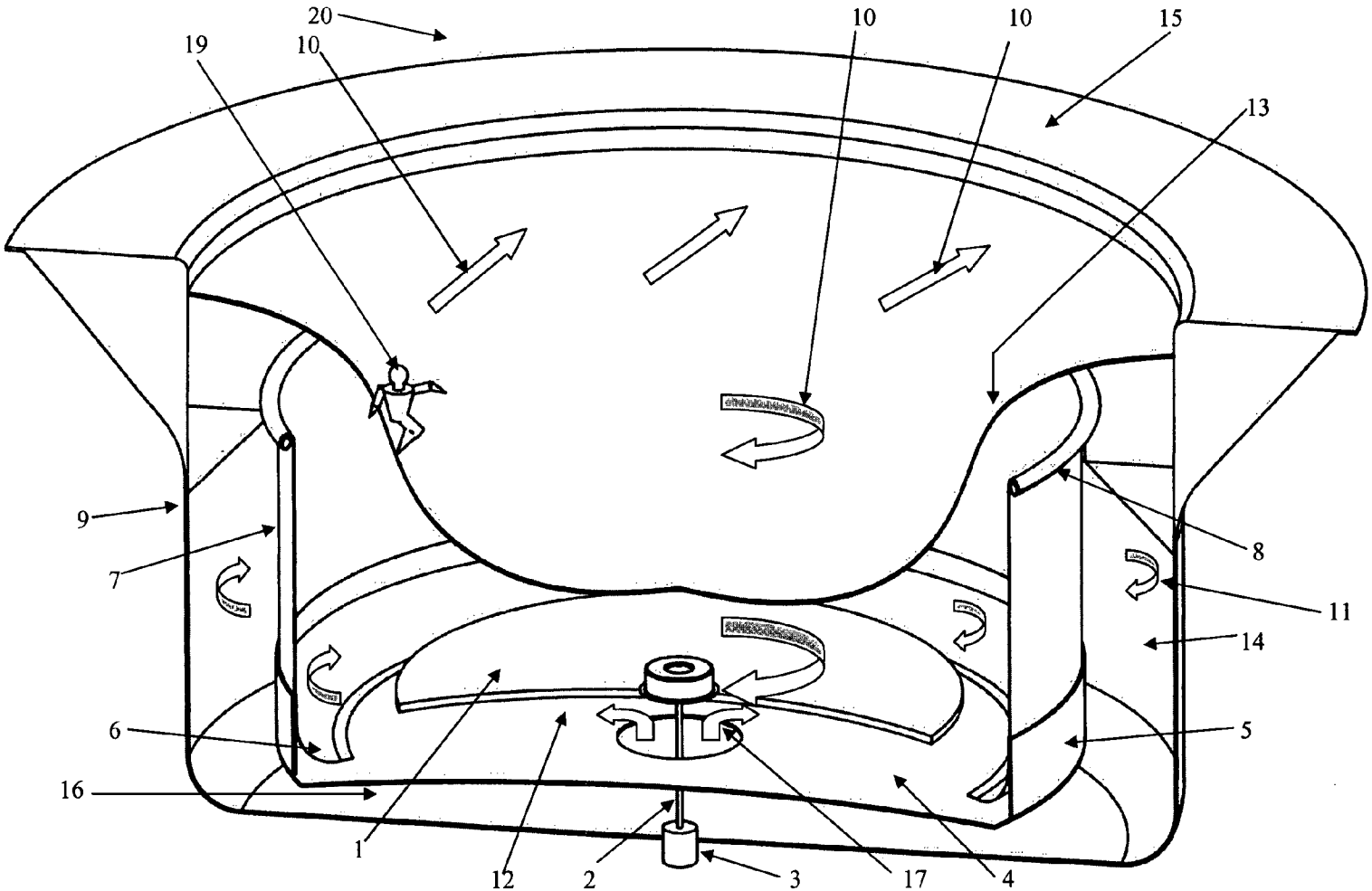
FIG. 1 shows an isometric sectioned view of the device in operation. In this view the wave generation device in installed in the ground at grade level.

FIG. 1 is a sectioned isometric view of the wave generating machine (20) showing the basic working parts. The first item to describe is the rotating disk (1) or impeller. The rotating disk (1) is attached to a shaft (2) that is connected to a motor (3). The motor (3) would typically be a hydraulic motor with hydraulic supply and return lines routed to a hydraulic pump mounted at the top level.

As shown in FIG. 1, the rotating disc (1), or impeller, is one of a combination of components that make up the wave generating system including a horizontal fixed base-plate or wall (4) a vertical fixed base-plate or wall (5) a deflection panel (6) an internal skirt (7) and a tubular support ring (8). The above mentioned components are housed in an outer shell (9). Although the outer shell (9) and internal skirt (7) are shown as circular in FIG. 1, it can be appreciated that they can be virtually any shape such as square, rectangular, or the like.

As further shown in FIG. 1, the rotating disc (1) imparts a rotational momentum or velocity to the water or fluid (10) by a mechanism of boundary layer drag that occurs at the boundary between the water and the rotating disc (1), or by transfer of energy caused by the affect or flutes, channels or grooves on the disc. The rotating disc (1) causes water to flow such that it follows a defined circuit. The rotating disc (1) can be flat or may be curved or shaped like a bowl. The defined primary circuit is represented by a series of arrows (11) is as follows.

The water is initially sucked up by the rotating disc (1) through a hole (17) in the fixed base plate (4). The water is channeled into an annulus (12) between the base plate (4) and the rotating disc (1) where it gathers additional angular momentum and velocity from the rotating disc (1). The water emerges from beneath the rotating disc (1) and is impinged onto the deflection panel (6) where it is deflected upward. The combination of centrifugal force and the upward component of velocity imparted onto the water by the deflection panel (6) cause the water to flow upward and outward against the internal skirt (7), like a whirlpool, forming a standing wave face (13). There is also a component of angular momentum imparted onto rotating water located in the area near the top surface of the rotating disc (1) that adds to the centrifugal forces creating the standing wave face (13). Due to the pumping (pushing and sucking) action of the rotating disc 1 the water flows up and over the tubular supporting ring (8). At this point the angular momentum of the rotating water is maintained as it spirals down through the annulus (14) formed by the internal skirt (7) and the optional outer shell (9). While maintaining its angular momentum the water continues to flow around the vertical base plate (5) and into the annulus (16) formed between the horizontal base plate (4) and the outer shell (9), where it again enters the hole (17) in the horizontal base-plate (4) to thus complete the circuit. A significant feature of this invention is the way the water flow (10) continues around the circuit in a manner where the kinetic angular momentum energy and static potential energy created by the differential elevation between the upper and lower portions of the wave form (13) are conserved resulting in a highly energy efficient design. Theoretically, once the standing wave form face (13) is up in a stable position of equilibrium, the only energy the system needs to operate is that required to overcome water drag against the various surfaces and appurtenances and any water disruption caused by the rider (19).

Figure 3:
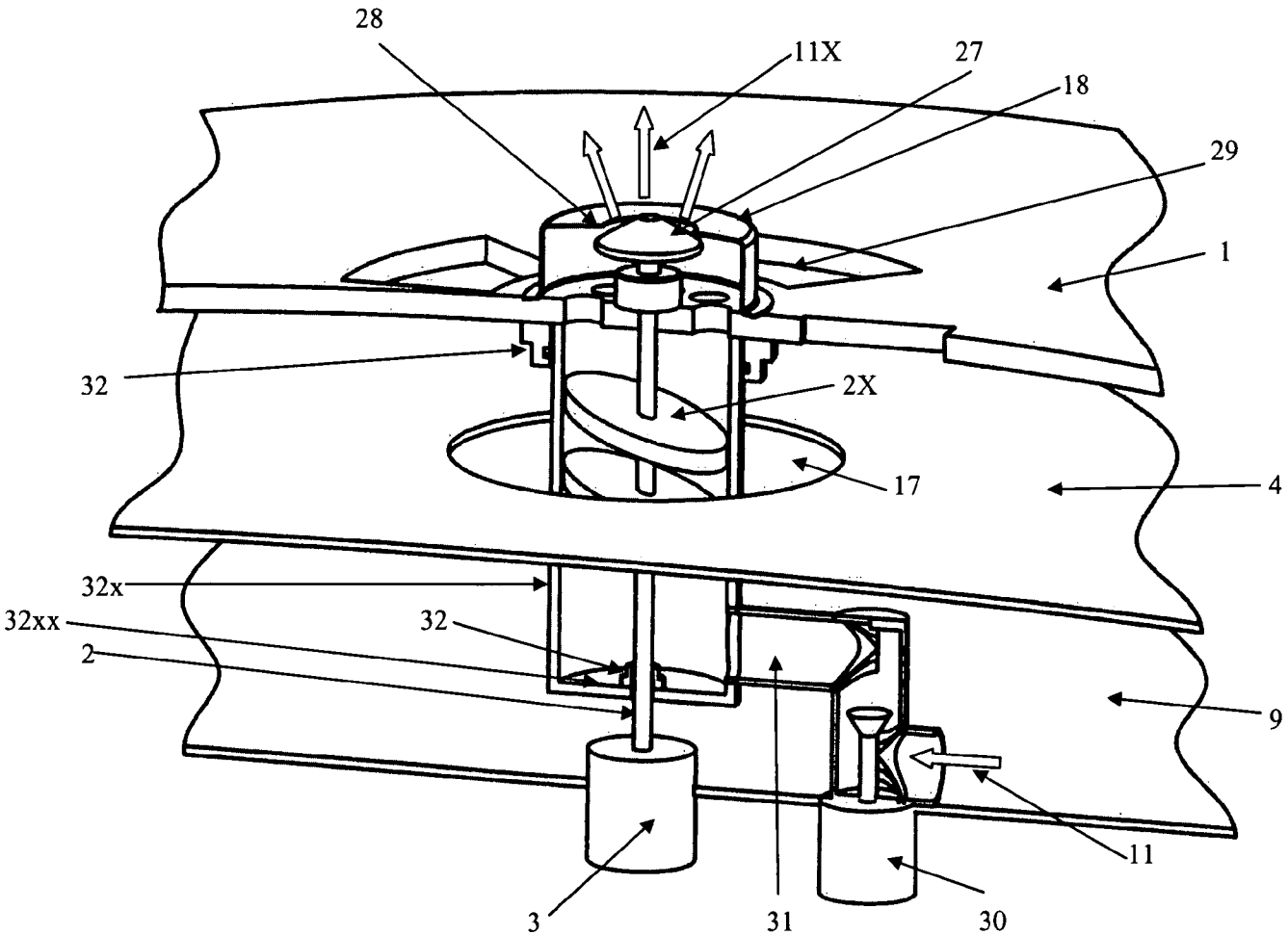
FIG. 3 shows a close up view of the center flow control feature with options that can be included. The plate or cone moves to restrict water flow though the center, as desired, to change the central area of the wave form surface. The view shows vents in the rotating disc near the central area if it is desired to lower the angular momentum transferred by the upper part of the disc to the water in the central area of the wave form. Also shown is one embodiment of a pump and ancillary piping and sealing components installed to augment the volume of water flow through the center flow feature.

A second flow circuit that can function in parallel with the primary circuit described above can be created by the addition of the center flow assembly (18). Water flow can emerge out of this channel by the head pressure created by the water level difference between the top and bottom of the wave form face (13), internal impellers fitted into the center flow assembly (18), or by a traditional pump, as shown in FIG. 3.

Entry and exit for the surfer (19) to ride the standing wave form (13) is from the deck (15) to the outer perimeter of the standing wave form (13) where the water is relatively flat.

Stairs could be incorporated to allow the surfer a convenient access from the deck (15) to the water. Enough distance would be provided between the circumference of the deck where it intersects the outside perimeter of the rotating wave form (13) and the tubular support ring (8) so as to create a flat area to allow the surfer (19) to paddle into the vertical section of the rotating wave form (13) similar to how a surfer paddles into a surfable wave occurring at the beach.

In reference to FIG. 1, it is pointed out that the since the rotating wave form (13) causes the internal skirt (7) to be in tension. Therefore the internal skirt (7), and possibly the outer shell (9) could be made of a lightweight fabric material that is less expensive than the more traditional wave machine construction materials. Although there would be an adequate water depth between the surface of the waveform (13) and the upper tube support ring (8) the tube support ring (8) could be covered with a padding material to lesson the likelihood of injury due to impact. Other that what is practical there is no limit to how large of a standing wave (13) that can be formed. For normal recreation a 1 to 3 meter wave may be adequate. Extreme models could produce waves of up to 10 meters for example. A final reference in FIG. 1 is to the surfer (19) who is enjoying the one of the most righteous rides of his life.

Figure 2:
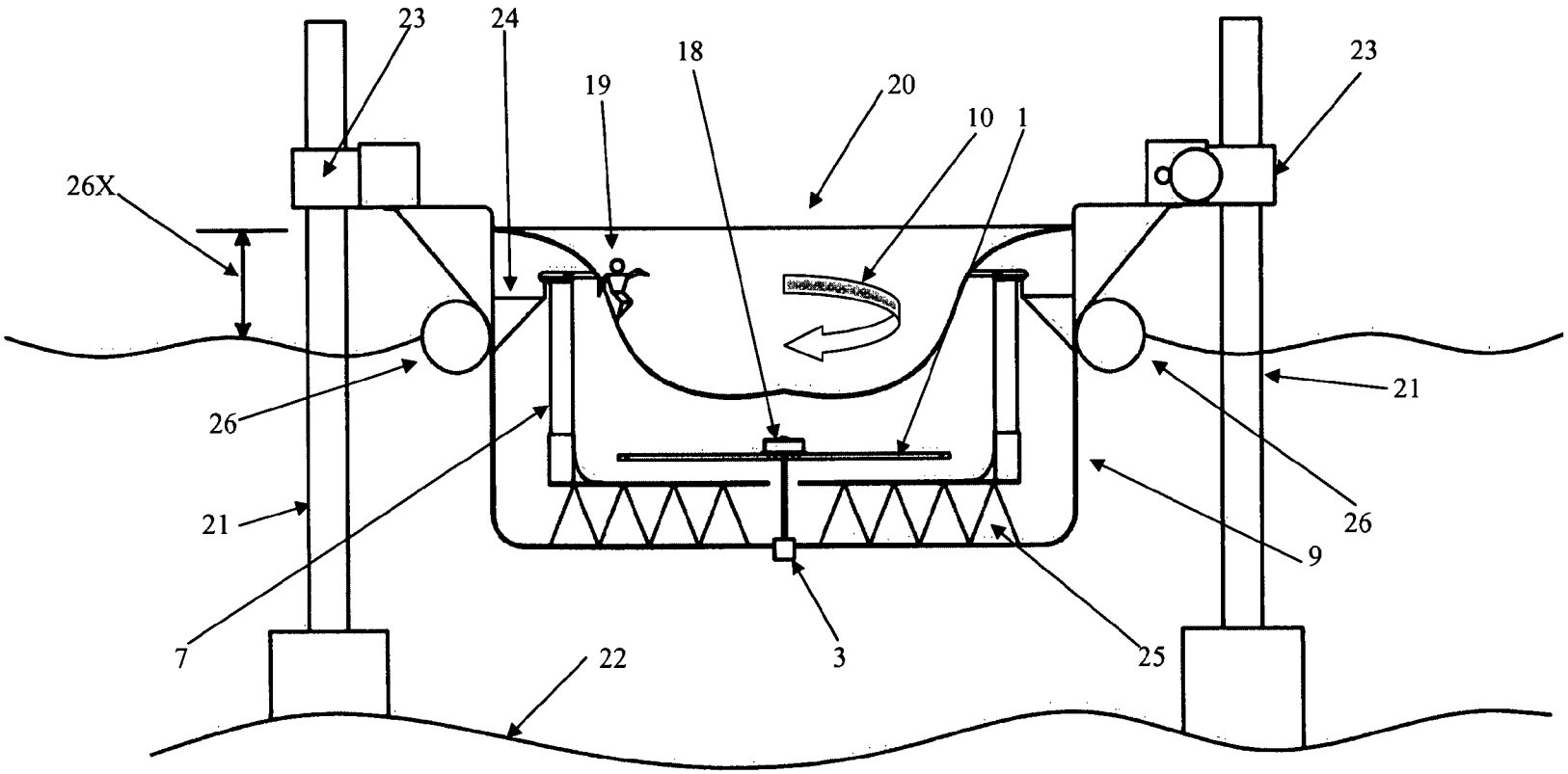
FIG. 2 shows a cross-sectioned view of the device in operation. In this view the wave generation device in installed in a lake, river, sea, or bay with pylons anchored into the ground and the bottom of the water. The pylons are attached to the wave generation to allow a rising and lowering of the device with changing tidal and loading conditions.

FIG. 2 shows a cross-sectional view of the wave generating device (20) in operation. In this view the wave generation device (20) is installed in a lake, river, sea, or bay with pylons (21) or pier supports anchored into the ground (22) at the bottom of the water. The pylons (21) are attached to the wave generating device (20) with mechanisms (23) to allow a rising and lower of the device with changing tidal and loading conditions.

Also visible in FIG. 2 are the mechanical supports to support the internal components of the wave generating device (20). A plurality of side-mounted truss (24) assemblies are used to rigidly support the tubular support ring (8) to the outer shell (9) or whatever other external structure is better suited. A plurality of bottom-mounted truss (25) assemblies rigidly support the horizontal base plate (4) to the outer shell (9), if installed, or whatever other external structure is better suited.

FIG. 2 shows the placement of the side-mounted truss (24) and bottom mounted truss (25) assemblies relative to the flow stream (10). As described above, the rotational energy of the water mass is conserved by this invention. To complement this feature the shape and design of the side-mounted truss (24) and the bottom-mounted truss (25) are to be hydrodynamic shapes incorporating foil shapes to reduce drag.

FIG. 2 shows buoyancy control systems (26) that can be adjusted with variable air fill, or other means, to add or decrease buoyancy of the wave generation device (20). These systems can be manually or automatically operated. In this example, negative buoyancy can be achieved with adding mass to the top or bottom of the outer shell (9) which may be made of a concrete and or steel. In the event the outer shell is made of a lighter material such as thin sheet or fabric, stability and desirable loading of the outer shell can be achieved by maintaining a determined elevation distance (26*x*) for the top of the wave generating device (20) above the water line.

Figure 5:
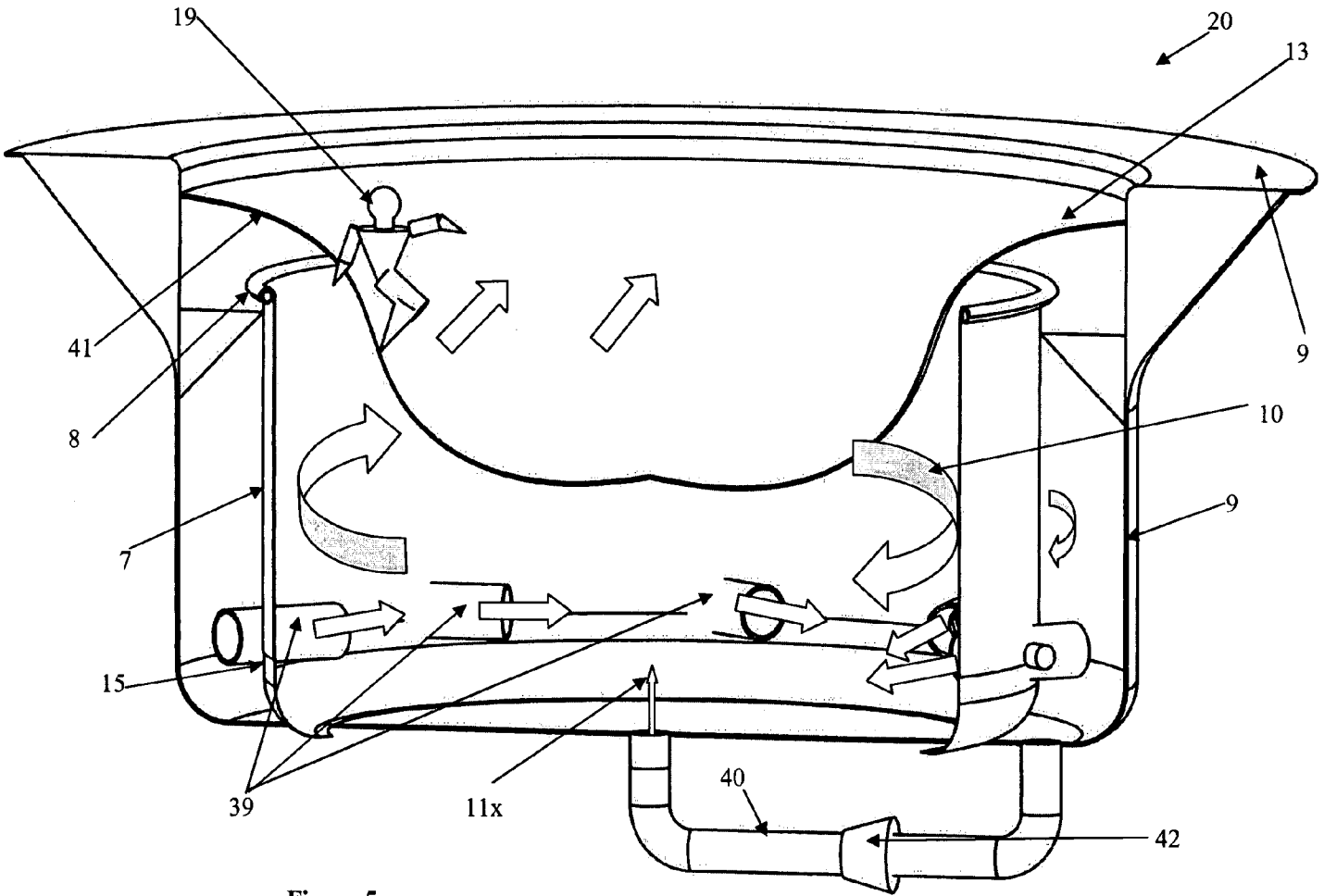
FIG. 5 shows another embodiment of the wave generation device where the angular momentum of the water is created by a plurality of pumps installed around the perimeter at the bottom near the base plate and below the skirt to pump water between the outer annulus and the inside wave form area.

FIG. 3 shows a close up view of the center flow control feature (18). A plate or cone (27) moves to restrict water flow (11*x*) though a center hole (28), as desired, causing a change in flow rate to affect a change to the central area of the wave form surface (13). The position of the cone (27) could be adjusted by an internal spring inside of the cone (27) pushing in one direction and a hydraulic pressure sent through the rotating shaft (2) pushing in the other direction. The view shows vents (29), or slots, in the rotating disc (1) near the central area to lower the angular momentum transferred by the top of the disc (1) to the water in the central area of the wave form (13). Also shown is one embodiment of a pump (30) and ancillary piping (31) and sealing components (32) installed to augment the volume of water flow (11) through the center flow feature (18). The pump (30) and the ancillary piping components (31) could be mounted in-line with the pump (30) and the rotating shaft (2). A mid-mount impeller (2*x*) or flute could be incorporated onto the rotating shaft (2), or a second and separate motor could be used to rotate a second shaft with impellers that is installed around the rotating shaft (2) allowing it to operate at a separate and higher rpm to adjustably push water flow (11*x*) out of the center flow assembly (18). A center flow extension (32*x*) could be fixed to the rotating disc (1) and rotate with internal auger-like impellers with a bottom end (32*xx*) open to act as an intake for flow from the lower annulus (16). It is noted that this water flow (11*x*) could flow because of the pressure differential between the top of the wave form (41) and the bottom (head pressure), without the need augmentation by a pump motor (42), as shown in FIG. 5.

Figure 4:
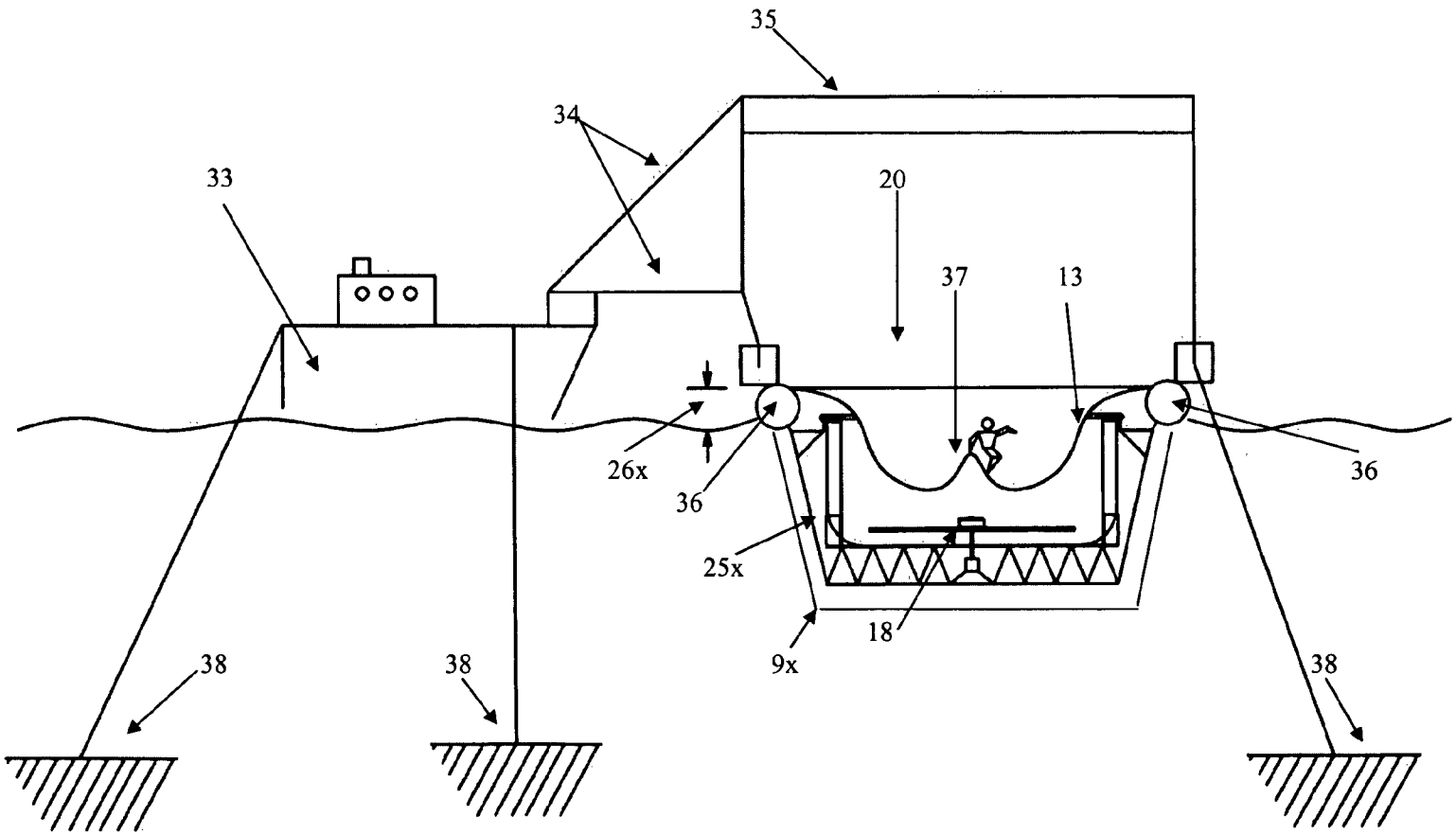
FIG. 4 shows a barge installation of the wave generating device in a lake, river, ocean, or bay. The wave form shows a hump in the center formed by the center flow control feature. This embodiment shows the device installed and in operation without the outer shell component.

FIG. 4 shows a barge (33), or boat, installation of the wave generating device in a lake, river, ocean, or bay. In this embodiment the wave generating device is attached to a barge (33) by a series of structural connections (34) to create a stable floating platform. In this embodiment an overhead beam (35) assembly is included to allow for maintenance, rescue, announcements, advertisements, or wave riding instruction. Floatation tanks (36) are shown that provide for adjustment of buoyancy. In this illustration the wave form has a hump (37) in the center area of the wave form created by a greater flow of water (11X) through the center flow assembly (18).

The embodiment shown in FIG. 4 shows the wave generating device installed and in operation without the use of the rigid outer shell component (9), resulting in a loss of some efficiency from the conservation of the angular momentum of the angular velocity of the water or fluid (10). The disadvantage of not using the outer shell component (9) is made up for by not having to provide a means to counteract the positive buoyancy created by the displacement of water in the bowl by the wave form (13). To use or not to use the outer shell (9) could depend on a number of factors, including limitations on barge or ship structures, portability, cost of manufacturing, wave form performance criteria, and cost of energy to operate the device, just to name some of the possibilities.

Without the outer shell (9) for structural support, the side-mounted trusses (24) and bottom-mounted supports (25) would require a joining structure (25*x*) to structurally join the two together. The joining structure (25*x*) could be a network of tubing, rods, bands, or plate material. An outer skirt (9*x*), probably of a fabric material, could be used to attempt to conserve the angular momentum of the rotational flow of the water or fluid (10) by directing it back along the previously described circuit (11) to the hole (17) in the horizontal base plate (4). The skirt (9*x*) could also function as a filter to mitigate debris from getting sucked up into the water circuit (1) forming the wave form (13)

The embodiment in FIG. 4 shows the use of anchors (38) to maintain the barge (33) and wave generating device in a stationary and stable position. Other devices could be used, such as pylons or bulkheads, for example.

FIG. 5 shows another embodiment of the wave generation device where the angular momentum of the water is created by a plurality of pumps (39) installed around the perimeter of the bottom near the vertical base plate (15) and near just below the internal skirt (7) to pump water between the annulus (14) and the wave form bowl area. The pumps (39) could be powered by hydraulic motors, be variable speed, and could be tilted and rotated to affect different wave form (13) characteristics. Nozzles could be installed at the outlet of the pumps (39) to channel the flow in a direction more tangential to the circumference of the wave form (13) rotation. The nozzles could augment water diverting attachments (45) that are described hereinbelow.

Also shown in FIG. 5 is a means of diverting water flow (11*x*) to the center area of the wave form (13) by use of a piping conduit (40). This water flow (11*x*) could flow because of the pressure differential between the top of the wave form (41) and the bottom (head pressure), or could be augmented by the pump motor (42).

Figure 6:
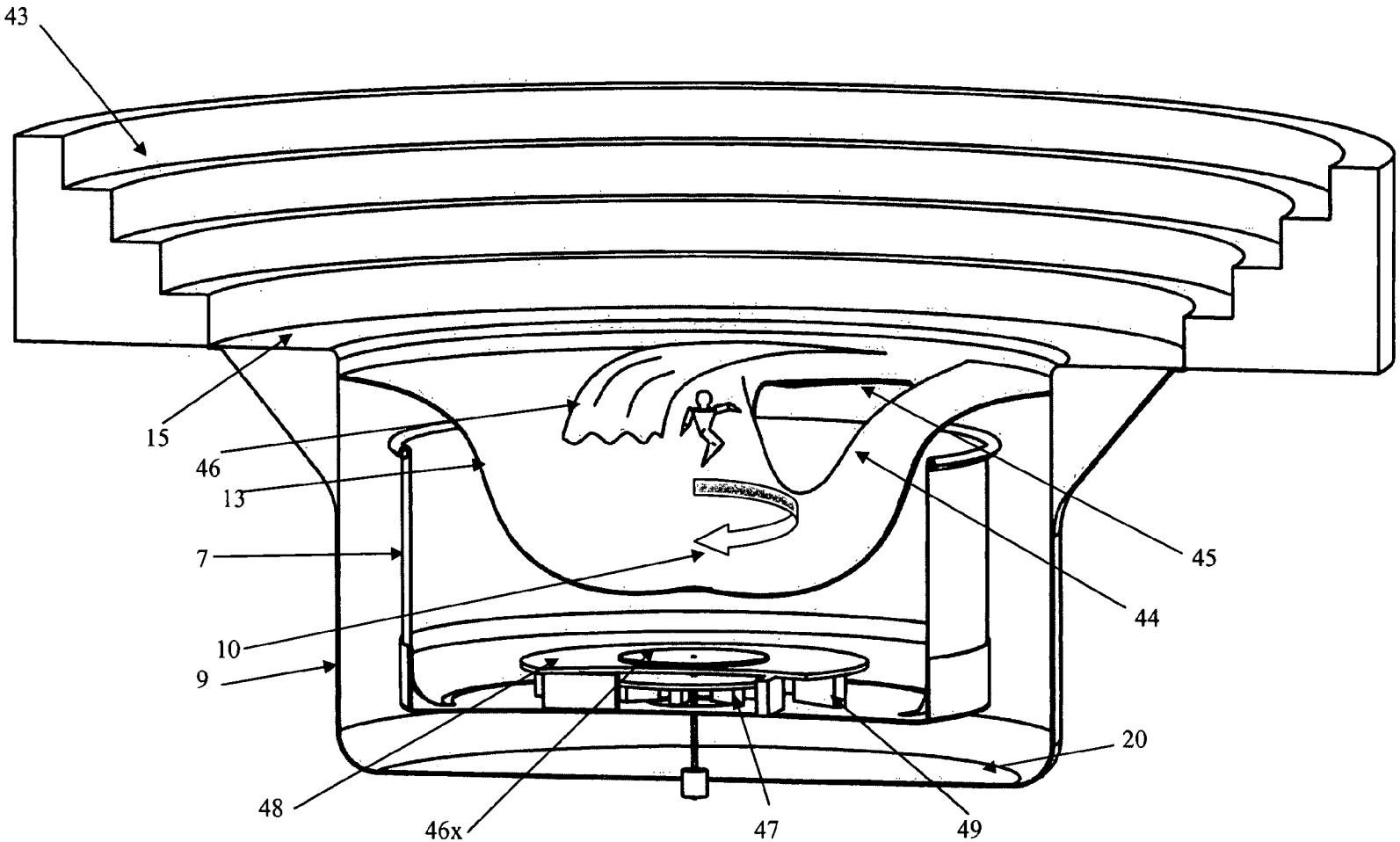
FIG. 6 shows the wave generation device installed in an arena setting. A cutaway of the water shows a water diverting attachment that curls the water up and over to create a hollow tube and lip for the rider to surf through, around, or over, and conduct trick moves and aerial maneuvers. Also shown is an enclosed traditional impeller with fixed stators and a free-wheeling or motorized cover plate on top of the impeller enclosure.

FIG. 6 shows the wave generation device installed in an arena (43) setting. A cutaway (44) of the water shows a water diverting attachment (45) that curls the water up and over to create a hollow tube-like water obstacle (46) and lip for the rider to surf through, around, or over, and conduct trick moves and aerial maneuvers. A plurality of attachments (45) could be installed at different levels around the circumference to form a sort of "race course" or "obstacle course" to conduct recreation or competition judged on quality of manoeuvres, speed, and or time around the course.

Figure 7:
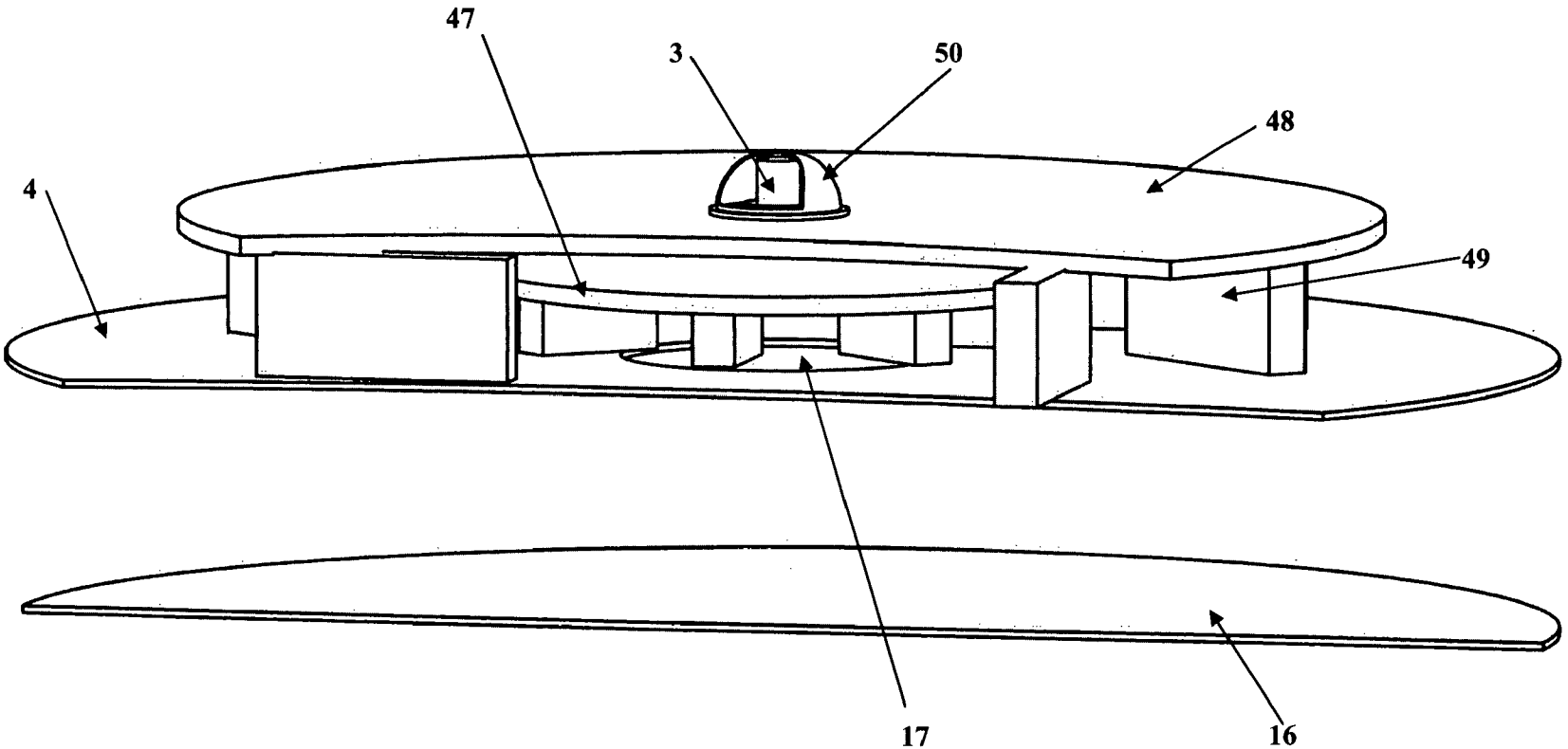
FIG. 7 shows a detail of an impeller that is enclosed within a fixed cover plate with fixed stators. The cutaway shows the position of the stationary stators, where the stationary stators are firmly affixing the fixed cover plate to the base plate. Also shown is a configuration where the motor driving the impeller is mounted on top of the fixed cover plate.

Also shown in FIG. 6, as well as FIG. 7, is an enclosed traditional impeller (47) with fixed stators (49). FIG. 6 shows the enclosed traditional impeller with a free-spinning plate (46*x*) on top of the impeller enclosure (48). The free-spinning plate (46*x*) could be allowed to rotate freely, be powered by a separate motor, or be connected to the impeller shaft if it there is a need to manipulate the angular momentum of the water in the central area of the wave form (13). The free-spinning plate (46*x*) could cover just a portion of the impeller enclosure (48), completely cover or extend beyond the impeller enclosure (48). The free-spinning cover plate (46*x*) could be flat or have a inward or outward dome shape and could be at various heights relative to the impeller enclosure. It is important to note that the free-spinning plate (46*x*) can be used with a rotating disc (1) without the use of an impeller enclosure (48). The free-spinning cover plate (46*x*) could also be covered with padding or incorporate a type of inflatable pillow for safety, structural, or buoyancy purposes.

FIG. 7 shows a detail of a traditional style of impeller (47) that is enclosed within a fixed cover plate (48) with adjustable stators (49). The impeller (47) can incorporate a variety of flute designs including straight or curved. The cutaway shows the position of the stationary stators (49), where the stationary stators (49) are firmly affixing the fixed cover plate (48) to the base plate (4). Also shown in this configuration is the motor (3) driving the impeller (47) mounted on top of the fixed cover plate (48). In this example the motor is encased in a dome-like enclosure (50) that would preferably have a padded cover.

The stators (49) shown in FIG. 7 can be hydrodynamically shaped and adjusted to impart the proper balance of angular and vertical velocity components to the fluid flow (10). In theory, the fluid direction could be 100 percent vertical, without any angular velocity. This would create a rideable standing wave very similar to an ocean wave. Energy would be conserved due to the siphon effect caused by the head pressure differential (based on mgh, where m=mass, g=acceleration of gravity, and h=height, or elevation differential of the water) between the top, or highest point, of the wave form (13) and the lowest point of the water surface near the centrally located opening of the base plate (17) shown in FIG. 1. In the preferred operation, some circular, or angular, velocity is desired to make the wave form smooth and have better reforming tendencies.

In the case of purely rotational or angular velocity, the centripetal force to begin enacting a closely vertical waveform can be modelled from the equations $F=ma$ and $a=v^2/r$, where $m \cdot g=m \cdot v^2/r$, and further solving for velocity results in $v=\sqrt{g} \cdot \sqrt{r}$. Velocity (v) is the tangential velocity at which the centripetal force is equal to the gravitational force acting on each "particle" of the fluid. Given that $\sqrt{g}$ (the square root of the value for the acceleration of gravity) is a constant, the velocity of the fluid is proportional to the square root of the radius. Therefore, in a purely rotational condition, the minimum tangential velocity required to begin enacting a vertical waveform (13) is determined by the radius somewhere between the diameter of the waveform (13) and the internal skirt (7). For example, from this calculation a waveform (13) with a diameter of 4 meters would result in a tangential velocity of about 4.4 meters/second or 15.8 kilometres per hour (9.9 miles per hour). Again, this is purely based on rotational or angular velocity and does not include the vertical velocity component of the fluid flow due to the head pressure differential described above, or, as it comes up off of the deflection panel (6), which could lower the rotational velocity required to maintain a vertical waveform (13). A 50% rotational and 50% vertical velocity component at this stage is likely to be optimal.

Also shown in FIG. 7 is a configuration where the motor (3) driving the impeller is mounted on top of the fixed cover plate (48). This configuration has certain benefits such as ease of accessibility and maintenance of the motor (3) and more structural rigidity of the shaft connection to the impeller (47).

Figure 8:
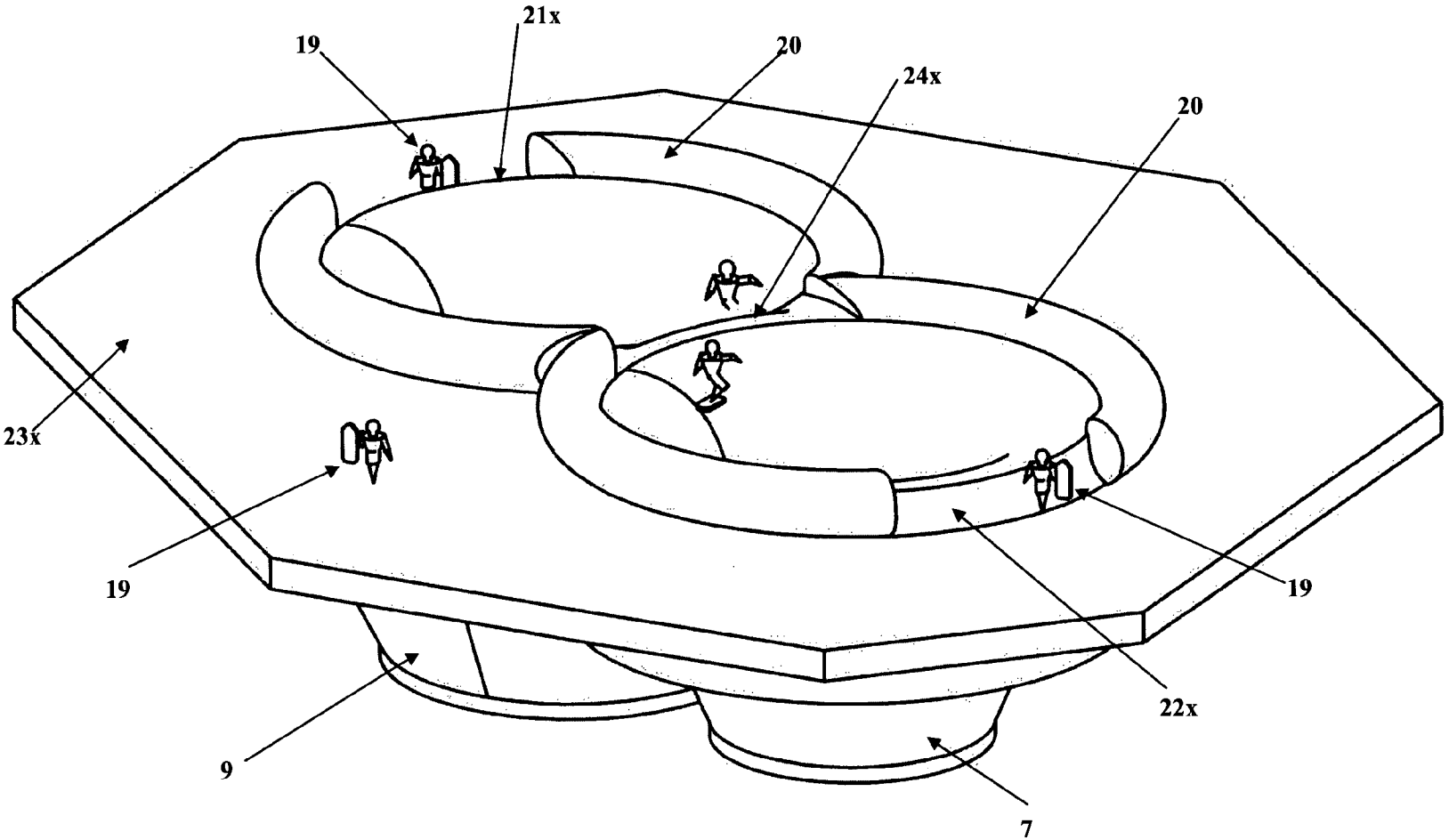
FIG. 8 shows where two wave generation devices are connected in series. The drawing shows an entry point and an exit point and a circuit where the rider walks from the said exit point to the said entry point. Where the two wave generation devices intersect is a region of constructive interference of fluid energy where a rideable wave-like pass-through is formed.

FIG. 8 shows an embodiment in which two wave generation devices (20) are connected in series. The drawing shows and entry point (21*x*) and an exit point (22*x*) and a circuit where the rider (19) walks on deck (23*x*) from the entry point (21*x*) to the exit point (22*x*). Where the two wave generation devices intersect there is an open and passable region of constructive interference of water energy that builds up and creates a rideable pass-through wave section (24*x*).

The series configuration of wave generation devices (20) shown in FIG. 8 is not limited to two devices. There would be an unlimited number of wave generation devices (20) that could be chained together. For the first time in surfing there could be timed events, such as in downhill skiing and motorsports, where the participants (19) on surfboards, or whatever form of board, would race against the clock.

The entry (21*x*) and exit (22*x*) portions of the wave generation device (20) shown in FIG. 8 would include a ramp or deck-like structure with a non-skid surface. The entry (21*x*) and exit (22*x*) portions would transition to the deck (23*x*) where the participants (19) would walk around, or to open water where the participants (19) would paddle from exit point (22*x*) to the entry point (21*x*). To maintain an organized and decent experience protocols similar to golfing can be adopted where either individuals or groups that are willing to ride together would be called out by a "starter", calling out a number or name as "on deck" or "in the hole". To expedite throughput, an individual who has waited in line and has his turn come up would have the option to have possibly up to three of his buddies join him or her on "their" three minute session.

In one preferred embodiment of the configuration shown in FIG. 8, where the series system is installed on an existing water way, such as shown in FIGS. 2 and 4, the deck (23*x*) may incorporate buoyancy control features. Tanks or compartments may be used to product ballast of floatation to provide the required stability or load distribution.

Figure 9:
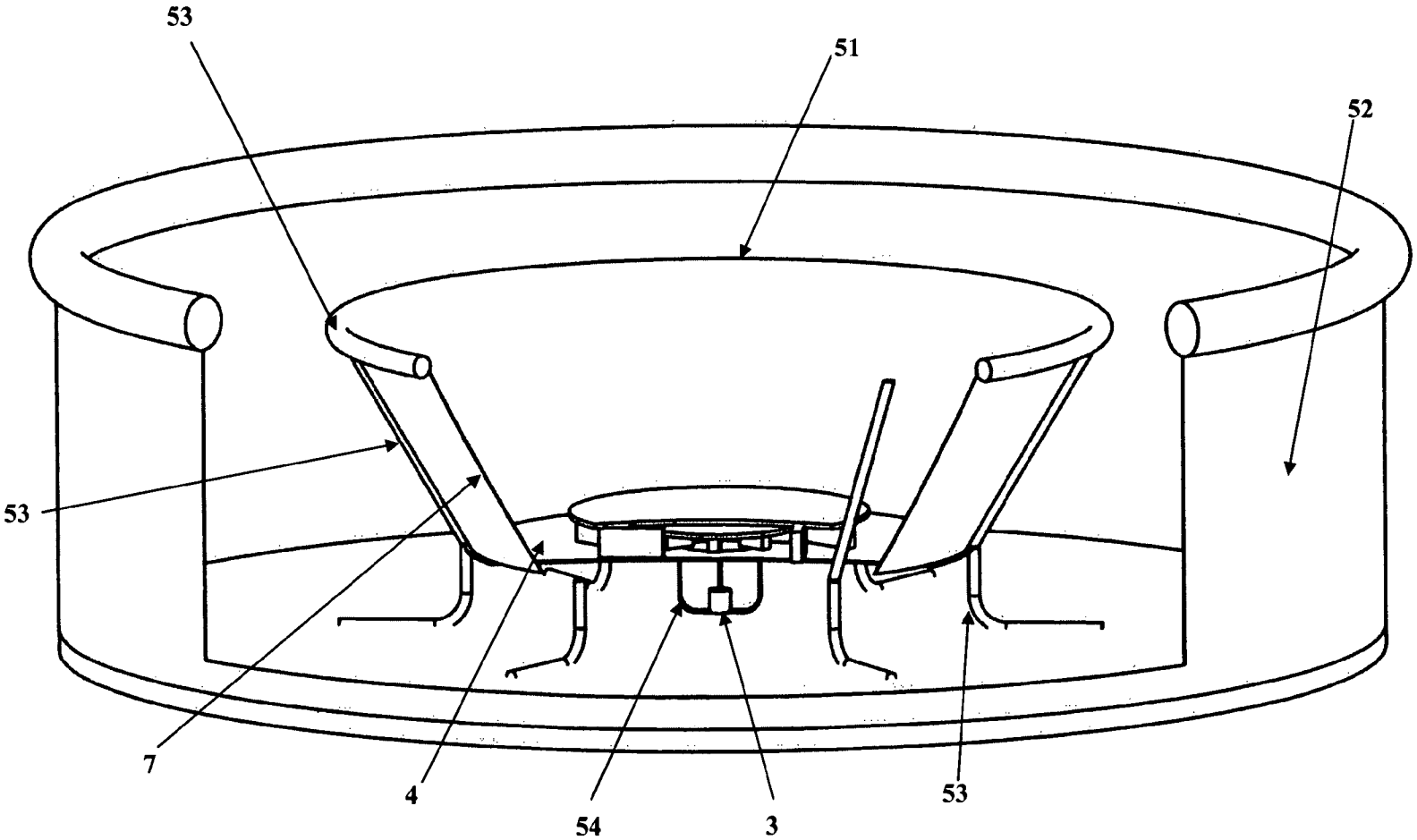
FIG. 9 shows a small wave generation device that is installed in a standard above-grade swimming pool. Simple and compact features are shown including the ease of dismantling and transporting, and the ability to install the unit many existing water pools or attractions.

FIG. 9 shows a smaller portable or fixed wave generation device (51) that is installed in a standard above-grade swimming pool (52). This configuration could be lower cost, easily dismantled and portable, or installed in many existing water pools or attractions. The portable unit (51) would include a rigid skeleton-like structure (53) and a fabric or semi-rigid inner wall (7). The motor (3) is shown in FIG. 9 with a mounting structure (54) installed below the base plate (4). The motor (3) could be mounted above or below the base plate (4).

The portable or fixed wave generation device (51) shown in FIG. 9 does not require an enclosing pool (52) or outer shell (9). The portable device (51) could be installed in an open body of water or an existing water attraction to form a playful contoured water surface.

Figure 10:
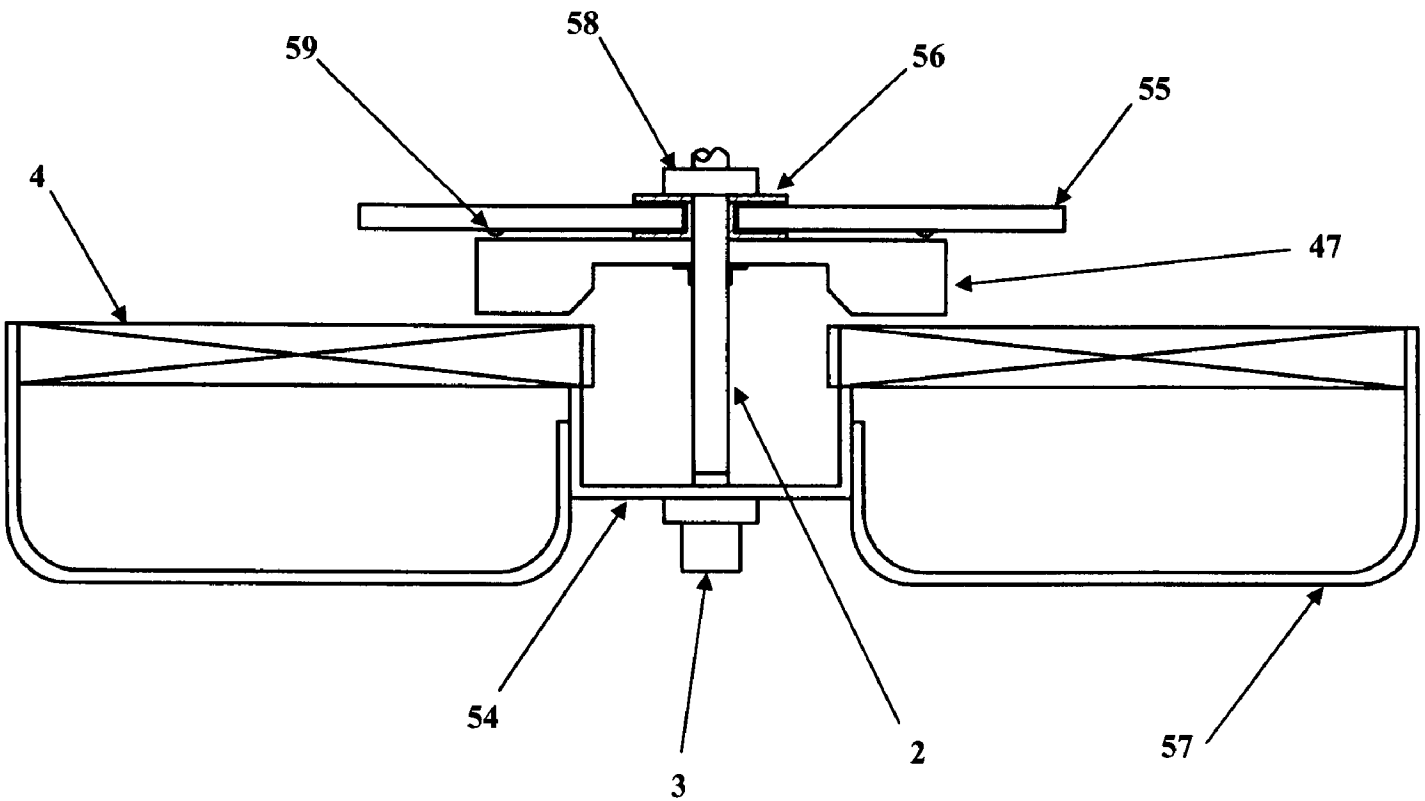
FIG. 10 provides more details describing an embodiment of the free-spinning plate that is designed to isolate the impeller from the participant, further conserve rotational energy, and enhance the hydrodynamics of the waveform by creating a more stable and flatter fluid surface in the central portion of the waveform.

FIG. 10 shows a detailed description of a free-spinning plate (55), similar in form and makeup to the free-spinning plate (46*x*) of FIG. 6. In this embodiment the free-spinning plate (55) covers the rotating disc or impeller (47) and is connected by means of a loose bearing coupling (56) to the shaft (2) that allows the free-spinning plate (55) to rotate freely and independently of the rotating disc or impeller (47). In this basic stand alone form the assembly includes the base plate (4), the motor (3), the shaft (2), the impeller (47) firmly connected to the shaft (2), the free-spinning plate (55), a bearing assembly (56), a locking collar device (58), a motor mounting structure, and the supporting structure (57). In this embodiment the bearing (56) is used between the shaft (2) and the free-spinning plate (55) so that the shaft (2) or the rotating disc or impeller (47) impart no rotational torque to the free-spinning plate (55) other than that which would occur due to the viscous coupling or viscous "clutch" affect. In this embodiment, the free-spinning plate (55) rotates at or near the angular velocity of the rotating fluid (10), creating a safer condition for anyone who tries to stand up in the center area because the relative angular velocity between the two should be near zero because the velocity of the person should be the same as the fluid flow (10) which should be the same as the free-spinning plate (55). The free-spinning plate (55) also enhances the stable and laminar flow pattern of the fluid from the impeller (47) and helps create a stable and smoother surface area on the waveform (13). The free-spinning plate (55) also has more energy efficiencies over a fixed impeller enclosure (48) of FIG. 6 due to the lower friction losses resulting from the lower relative velocities between the impeller (47) and the free-spinning plate (55). The free-spinning plate (55) could be enhanced with vents (29), as shown in FIG. 3, to adjust rotational and waveform characteristics.

Figure 11:
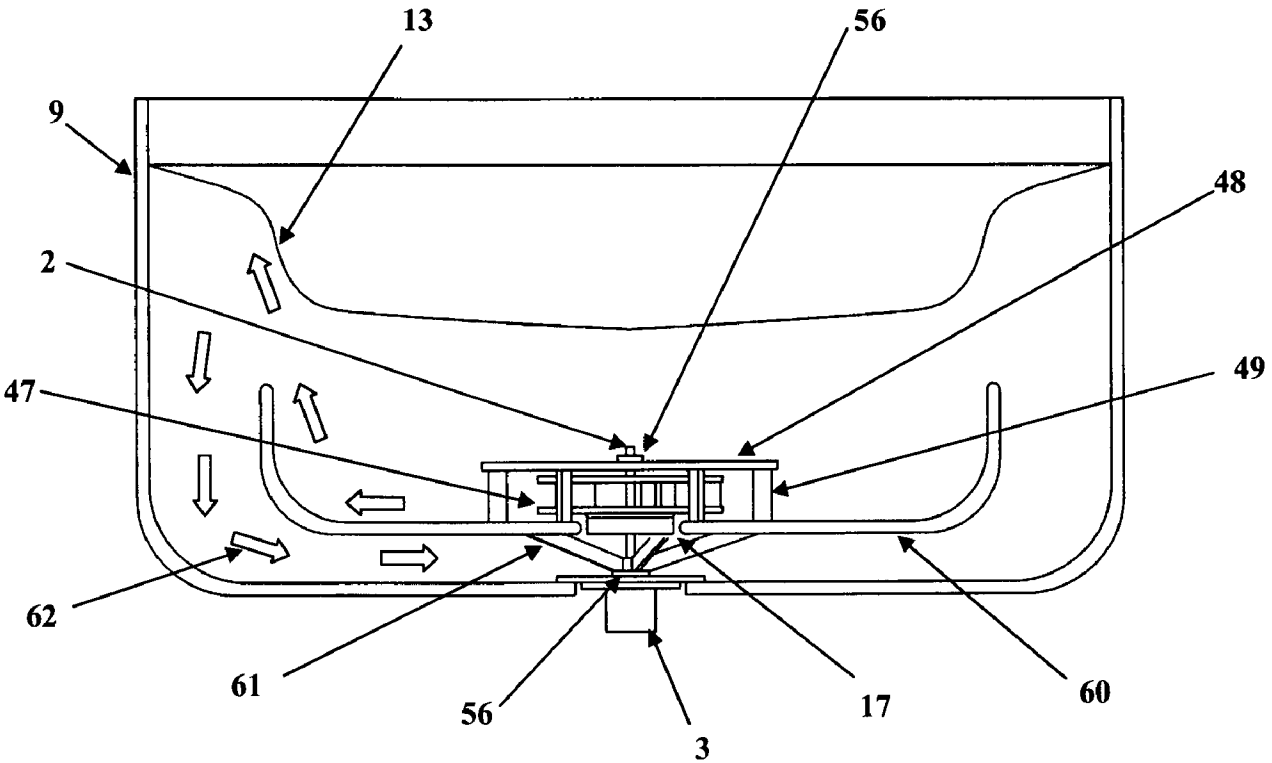
FIG. 11 provides more details describing an embodiment of a free-spinning base-plate and cover plate assembly that rotates independently of the impeller and shaft, conserving rotational and head pressure energy, and enhancing the hydrodynamics of the waveform.

FIG. 11 shows a description of a free-spinning horizontal base-plate (4), here labelled as a free-spinning base-plate (60), similar in form, benefit, and makeup to the free-spinning plate (55) of FIG. 10. In this embodiment the free-spinning base-plate (60) is firmly fixed to the fixed cover plate (48) by means of the adjustable stators (49). The assembly of the free-spinning base-plate (60) and the fixed cover plate (48) encloses the rotating impeller (47) and is connected by means of loose bearing couplings (56) to the shaft (2) that allows the described assembly to rotate freely and independently of the rotating disc or impeller (47), similar to that described in FIG. 10. In this embodiment there is additional support structure (61) to carry the load from the assembly of the free spinning base-plate (60) and the fixed cover plate (48) to the bottom loose bearing coupling (56). In this embodiment the bearings (56) are used between the shaft (2) and the free-spinning base-plate assembly (48,49,60,61) so that the shaft (2) or the rotating disc or impeller (47) impart no rotational torque to the free-spinning base-plate assembly (48,49,60,61) other than that which would occur due to the viscous coupling or viscous "clutch" affect. The option exists to incorporate a mechanical or fluid clutch assembly to partially transmit load, or use further fluid drive enhancements such as channels, ribs, flutes, angled stators, or foiled stators to impart rotational velocity to the free-spinning base-plate assembly (48,49,60,61). In this embodiment, the free-spinning base-plate assembly (48,49,60,61) rotates at or near the angular velocity of the fluid (10), creating a safer condition for anyone who tries to stand up in the center area because the relative angular velocity between the two should be near zero since the velocity of the person should be the same as the fluid flow (10) which should be the same as the free-spinning base-plate assembly (48,49,60,61). As shown in FIG. 11, the free-spinning base-plate (60) can have a tapered, angled, or vertical portion of its outer perimeter to deflect fluid flow (10) in the vertical direction. The non-rotational component of the fluid flow (10) caused by the pumping action described in the previously defined flow circuit is shown with arrows (62).

Figure 12:
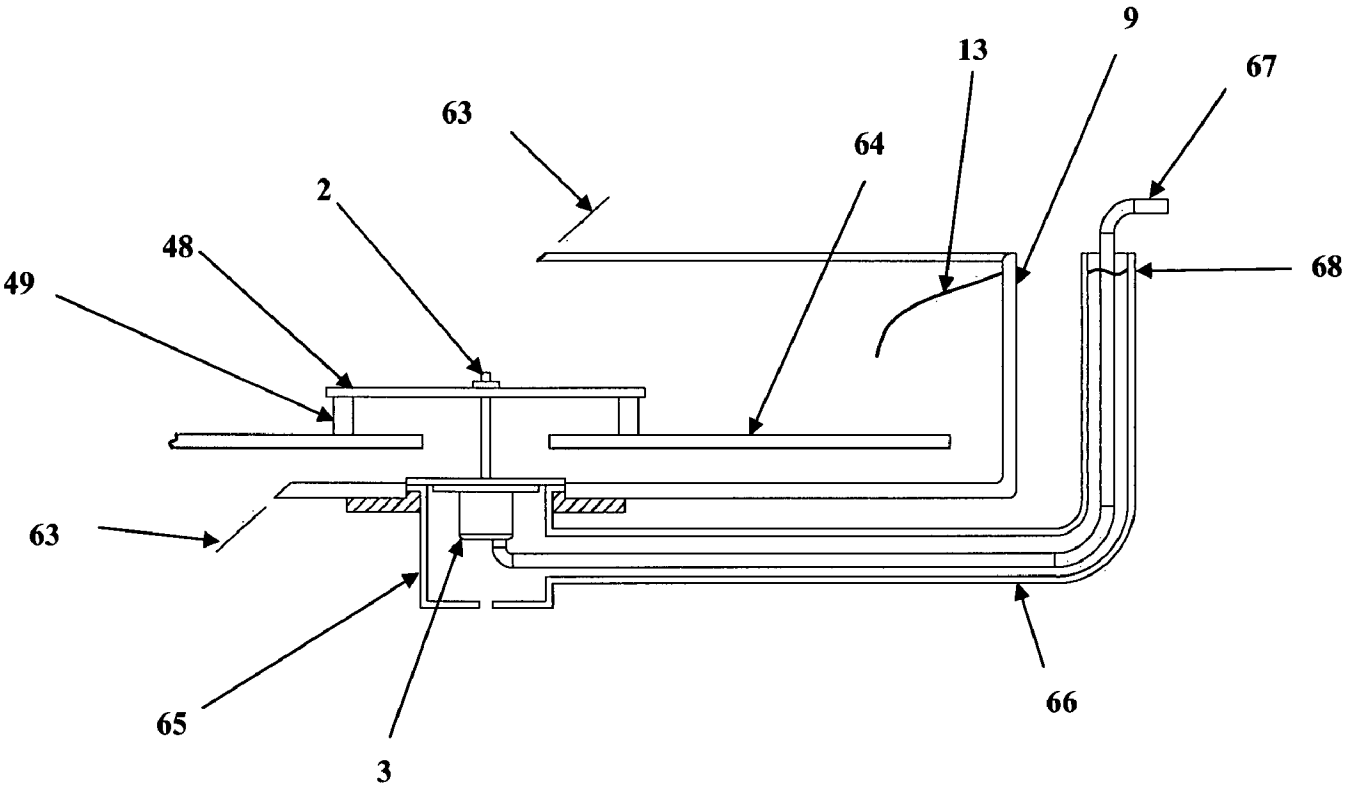
FIG. 12 provides more details describing an embodiment of a driven base-plate and cover plate assembly that is powered by a motor and acts as an impeller to impart rotational and vertical velocity to the water and incorporates a motor access vault, access conduit, and power conduit to improve operation and maintenance of the system.

FIG. 12, with the outer pool (9) sectioned along a line (63), shows a description of a power driven horizontal base-plate (4) here labelled as a power driven base-plate (64). In this embodiment the power driven base-plate (64) is firmly fixed to the fixed cover plate (48) by means of the adjustable stators (49). The assembly of the power driven bsase-plate (64), fixed cover plate (48), and stators (49) are fixed to the shaft (2) that is powered by the motor (3). The power driven base-plate assembly (2,48,49,64) act as an impeller to impart rotational and vertical velocity to the water as per the prior descriptions of the flow circuit.

FIG. 12 shows a motor access vault (65), access conduit (66), and power conduit (67) used to improve operation and maintenance of the system. The motor access vault (65), access conduit (66), and power conduit (67) could be any size, from just large enough to enclose tubing or piping for hydraulic feed and return lines, or large enough to accommodate maintenance personnel and intake and exhaust from a combustion engine. The motor access vault (65) and access conduit (66) could serve as a double-containment vessel to address environmental concerns of oil or contaminants leakage from the motor (3). The access conduit (66) when raised to a level above the wave form (13) water level could allow a water channel level (68) to form, creating a condition where the motor (3) could be accessed from the water-side of the wave form (13) without having to drain the pool formed by the outer container (9). The motor access vault (65) and access conduit (66) could also be spaced apart concentrically to provide structural components for a floating device as shown in FIG. 4, and to provide ballast or buoyancy by filling with either sand or concrete or air.

In the present specification and claims (if any), the word "comprising" and its derivatives including "comprises" and "comprise" include each of the stated integers but does not exclude the inclusion of one or more further integers.

The above description describes the general operation of the water feature apparatus. Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

What is claimed is:

1. A device for generating and maintaining a standing wave force comprising:

a primary container having a base wall and a side wall, said base wall provided with a central opening through which a fluid flows and is maintained in said primary container; and a rotatable impeller having an input side and an output side, said impeller situated over said central opening and provided with a plurality of stators imparting radial flow to the fluid within the primary container, said rotatable impeller producing a continuous fluid flow from said output side of said impeller through at least a portion of said primary container and into said input side of said impeller.

2. The device in accordance with claim 1 wherein said primary container is circular and wherein said side wall is cylindrical.

3. The device according to claim 2 further including a secondary container also containing a fluid and wherein the primary and secondary containers are spaced apart concentrically.

4. The device according to claim 1 further comprising an outer, secondary container, said secondary container also containing a fluid.

5. The device according to claim 4 wherein sufficient distance is provided between the primary and secondary containers such that a flattened portion of fluid is formed at an upper region between the primary and secondary containers.

6. The device according to claim 4 wherein the fluid in the secondary container rotates as does the fluid in the primary container.

7. The device according to claim 4 wherein support means is provided to support said primary container within said secondary container.

8. The device according to claim 1 wherein the base wall of the primary container is provided with upstanding edge portions or skirts and an arcuate portion therebetween.

9. The device according to claim 8 wherein said arcuate portion acts as a deflection means to deflect the fluid which is forced outwardly due to the rotational and centrifugal forces acting on the fluid, upwardly.

10. The device according to claim 9 further including an upstanding sidewall.

11. The device in accordance with claim 1, where said base wall is immobile.

12. The device in accordance with claim 1, where said base wall is free spinning.

13. The device in accordance with claim 1 wherein said stators are adjustable.

14. The device in accordance with claim 13 further including a motor connected to a drive shaft, said drive shaft connected to said impeller, said motor and drive shaft allowing said impeller to rotate.

15. The device in accordance with claim 1 further provided with a fixed cover plate and a free-spinning base plate.

16. The device in accordance with claim 15 wherein said free-spinning base plate is provided with a vertical side wall.

17. The device in accordance with claim 15 further including a bearing assembly connected to said free-spinning base plate, allowing said free-spinning base plate to rotate independently of said impeller.

18. The device in accordance with claim 1 wherein said rotatable impeller imparts rotational velocity to the fluid.

19. The device in accordance with claim 1 wherein said primary container is provided with an upstanding side wall surrounding said primary container, and further wherein the height of the fluid proximate to said side wall is greater than the height of the fluid above said impeller.

20. A device for generating and maintaining a standing wave force comprising:

a first container having a base wall and a side wall, said base wall of said first container provided with a first central opening through which a fluid flows and a portion of which is maintained in said first container;

a first rotatable impeller having an input side and an output side, said first impeller situated over said first central opening imparting radial velocity to the fluid within said first container, said rotatable first impeller producing a continuous fluid flow from said output side of said first impeller through at least a portion of said first container and into said input side of said first impeller;

a second container having a base wall and a side wall, said side wall of said second container provided with a second central opening through which fluid flows and a portion of which is maintained in said second container;

a second rotatable impeller having an input side and an output side, said second impeller situated over said second central opening imparting radial velocity to the fluid within said second container, said second rotatable impeller providing a continuous fluid flow from said output side of said second impeller through at least a portion of said second container and into said input side of said second impeller; and a spill way provided between said first and second container to allow fluid to flow between said first and second container.

21. The device in accordance with claim 20 wherein each of said first and second containers are circular and each of said sidewalls is cylindrical.

22. The device in accordance with claim 20 wherein said first and second rotatable impellers imparts rotational velocity to the fluid.

23. A device for generating and maintaining a standing wave force comprising:

a primary container having a base wall and a side wall, said base wall provided with a central opening through which a fluid flows and is maintained in said primary container; and a rotatable impeller having an input side and an output side, said impeller situated over said central opening and provided with a plurality of stators imparting non-rotational radial flow to the fluid within the primary container, said rotatable impeller producing a continuous fluid flow from said output side of said impeller through at least a portion of said primary container and into said input side of said impeller.

24. The device in accordance with claim 23 wherein said primary container is provided with an upstanding side wall surrounding said primary container, and further wherein the height of the fluid proximate to said side wall is greater than the height of the fluid above said impeller.

* * * * *